US007706706B2

(12) United States Patent
Frauens et al.

(10) Patent No.: US 7,706,706 B2
(45) Date of Patent: Apr. 27, 2010

(54) METHOD AND SYSTEM FOR WIDE FORMAT TONING

(75) Inventors: Michael W. Frauens, Webster, NY (US); Eric C. Stelter, Pittsford, NY (US); Joseph E. Guth, Holley, NY (US); Laverne N. Lincoln, Jr., Macedon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/259,310

(22) Filed: Oct. 28, 2008

(65) Prior Publication Data

US 2009/0052914 A1 Feb. 26, 2009

Related U.S. Application Data

(62) Division of application No. 10/810,475, filed on Mar. 26, 2004.

(60) Provisional application No. 60/458,166, filed on Mar. 27, 2003.

(51) Int. Cl.
*G03G 15/00* (2006.01)

(52) U.S. Cl. ..... 399/49

(58) Field of Classification Search ..... 399/49; 347/55, 103

See application file for complete search history.

(56) References Cited

U.S. PATENT DOCUMENTS

| | | | | |
|---|---|---|---|---|
| 3,202,092 | A | | 8/1965 | Childress |
| 3,306,193 | A | | 2/1967 | Rarey et al. |
| 3,504,624 | A | | 4/1970 | Kennedy, Jr |
| 4,041,901 | A | | 8/1977 | Rarey et al. |
| 4,261,289 | A | | 4/1981 | Bock |
| 4,473,029 | A | | 9/1984 | Fritz et al. |
| 4,602,863 | A | | 7/1986 | Fritz et al. |
| 5,546,165 | A | | 8/1996 | Rushing et al. |
| 5,677,719 | A | * | 10/1997 | Granzow ..... 347/103 |
| 5,848,339 | A | | 12/1998 | Costrop et al. |
| 5,900,893 | A | * | 5/1999 | Joly et al. ..... 347/55 |
| 6,074,112 | A | * | 6/2000 | Desie et al. ..... 400/118.3 |
| 6,102,523 | A | * | 8/2000 | Desie et al. ..... 347/55 |
| 6,174,095 | B1 | | 1/2001 | Desie et al. |
| 6,212,348 | B1 | | 4/2001 | Inoue et al. |
| 6,246,424 | B1 | | 6/2001 | Desie et al. |
| 6,339,686 | B2 | | 1/2002 | Yamanaka et al. |
| 6,342,273 | B1 | | 1/2002 | Handels et al. |
| 6,483,997 | B1 | | 11/2002 | Nakazato |
| 6,493,517 | B1 | | 12/2002 | Hanson |
| 6,571,077 | B2 | | 5/2003 | Thompson et al. |
| 6,606,474 | B2 | | 8/2003 | Sirejacob |
| 6,671,052 | B1 | | 12/2003 | Rushing |
| 6,728,503 | B2 | | 4/2004 | Stelter et al. |
| 6,731,888 | B2 | | 5/2004 | Suzuki et al. |

FOREIGN PATENT DOCUMENTS

| | | |
|---|---|---|
| WO | 97/16770 | 5/1997 |
| WO | 98/27466 | 6/1998 |

* cited by examiner

*Primary Examiner*—Quana M Grainger
(74) *Attorney, Agent, or Firm*—Donna P. Suchy

(57) ABSTRACT

A printer or other powder deposition device may include multiple toning stations, and the toning stations may be positioned in various configurations within the device. The various configurations may position the toning stations so as to increase the toning width of the device, thereby allowing the device to print larger process widths. The device may also perform processing control for the multiple toning stations.

18 Claims, 16 Drawing Sheets

METHOD AND SYSTEM FOR WIDE FORMAT TONING

CROSS REFERENCE TO RELATED APPLICATIONS

This is a divisional application of U.S. Ser. No. 10/810,475 filed Mar. 26, 2004, entitled "Method and System For Wide Format Toning" by Frauens, et al which claims the benefit of U.S. Provisional Application No. 60/458,166, filed Mar. 27, 2003, each of which are commonly assigned to Eastman Kodak Company and herein incorporated by reference.

FIELD OF THE INVENTION

This invention relates generally to deposition of electrically charged powder in electric fields. More specifically, it relates to the configuration of toning stations used in electrographic printers, electrophotographic printers or powder coating devices.

BACKGROUND OF THE INVENTION

Processes for developing electrostatic images using dry toner are well known in the art. Such development systems are used in many electrographic or electrophotographic printers and copiers (collectively referred to herein as "printers") and typically employ a developer consisting of toner particles, hard magnetic carrier particles and other components. Magnetic brush development may also be used for powder coating applications. In many current and prior art developers, the carrier particles are much larger than the toner particles, on the order of up to 30 times larger.

The developer is moved into proximity with an electrostatic image carried on a receiver, whereupon the toner component of the developer is deposited on the receiver. Deposition of toner onto the receiver is driven by the electric field between the electrostatic image on the receiver and the magnetic brush. In electrophotographic printers the receiver is a photoconductor, and the toner is subsequently transferred to a sheet of paper or other final receiver to create the final output of the device, which can be an image. Developer is moved into proximity with the electrostatic image by a rotating toning shell, an electrically-biased, conductive metal roller that is rotated cocurrent with the photoconductor, such that the opposing surfaces of the photoconductor and toning shell travel in the same direction. For powder coating applications, an electric field drives toner deposition from the developer onto a substrate or receiver, which can be electrostatically charged or to which a bias voltage can be applied relative to the toning shell.

Located inside the toning shell is a multipole magnetic core, having a plurality of magnets, that is either fixed relative to the toning shell or that rotates, usually in the opposite direction of the toning shell. The developer is deposited on the toning shell and the toning shell rotates the developer into proximity with the receiver, at a location where the receiver and the toning shell are in closest proximity, referred to as the "toning nip."

On the toning shell, the magnetic carrier component of the developer forms a "nap," similar in appearance to the nap of a fabric, because the magnetic particles form chains of particles that rise vertically from the surface of the toning shell in the direction of the magnetic field. The nap height is maximum when the magnetic field from either a north or south pole is perpendicular to the toning shell. Adjacent magnets in the magnetic core have opposite polarity and, therefore, as the magnetic core rotates, the magnetic field also rotates from perpendicular to the toning shell to parallel to the toning shell.

When the magnetic field is parallel to the toning shell, the chains collapse onto the surface of the toning shell and, as the magnetic field again rotates toward perpendicular to the toning shell, the chains also rotate toward perpendicular again. Thus, the carrier chains appear to flip end over end and "walk" on the surface of the toning shell and, when the magnetic core rotates in the opposite direction of the toning shell, the chains walk in the direction of photoconductor travel.

The magnetic toning roller and toning shell are located in a housing or sump, in which fresh toner is mixed with the magnetic developer and applied to the toning shell. Augers and ribbon blenders are typically used to mix developer and fresh toner. Bucket assemblies, magnetic rollers internal to the sump or paddle wheels are used to apply the developer to the toning shell. The amount of developer applied to the toning shell is usually limited by a skive adjacent to the toning shell, which extends down the length of the toning shell and is spaced uniformly from the toning shell.

Exemplary development systems that implement hard magnetic carriers are described in U.S. Pat. Nos. 4,473,029 and 4,546,060, the contents of which are incorporated by reference as if fully set forth herein. Alternatively, in other development systems the toning shell may or may not rotate. Other developments systems implement magnetic carriers that are not hard (i.e. soft). Still alternatively, in other development systems the magnetic core may not rotate.

Ideally the toning shell and the magnetic core are as long as necessary to provide the developer to the entire printing width of a printer. In the case of coating applications, the toning shell and the magnetic core are as long as necessary to provide developer to the entire width of the substrate. The toning width could be increased by increasing the length of the toning station; however, the overall length of the toning station described above is limited by manufacturing tolerances for these components and the adverse effects these longer components have on image quality. Thus, increasing the length of the toning station causes a corresponding decrease in the uniformity of the toner deposition and the image quality of a printer or other powder deposition device.

Many common printing applications and powder coating applications require a larger toning width. For these applications there exists a tradeoff between increasing the length of the toning roller and maintaining the uniformity of toner deposition, and therefore also the uniformity of laydown in a coating system or the image quality in a printer. That is, the toning width could be increased by increasing the length of the toning roller, but runout, spacing differences to the receiver along the length of the roller or other non-uniformities in the longer toning roller would cause a decrease in the uniformity of toner deposition and the image quality. Similarly, the uniformity of toner deposition and the image quality could be maintained by using a shorter toning roller with more precise dimensions, which would then decrease the toning width of the development station.

Therefore, there exists a need to provide an improved system for increasing the toning width of a printer or other toner deposition system while still maintaining the quality of the resulting image and the uniformity of toner deposition.

SUMMARY OF THE INVENTION

A printer or other deposition device for charged powder may include multiple toning stations. The multiple toning stations may be arranged in the device so as to increase a toning width of the device, thereby allowing the device to deposit particles or to print onto larger process widths.

The toning stations may be arranged in a variety of different configurations. In various embodiments, the toning stations may be positioned to overlap or to have gaps between the toning stations. In various embodiments, the toning stations may be oriented substantially perpendicular to a receiver transport axis in the printer, or they may be angled with respect to the receiver transport axis. In other embodiments, the toning stations may be configured to support simultaneous duplex printing.

In various embodiments, overlapping toning stations may use a metering skive to control the amount of toner particles deposited at different locations on the toning rollers. In one embodiment, a skive may be stepped to provide different spacing between the skive and the toning roller at different positions along the toning roller. In another embodiment, the skive may be tapered to provide different spacing between the skive and the toning roller at different positions along the toning roller. Other methods might be used to adjust the maximum width of toner deposition, such as limiting the width of the applicator assembly that deposits developer from a sump onto the toning shell.

The printer may also provide process control functions for the toning stations. In one embodiment, the printer may include multiple sets of overlapping toning stations, and each toning station within a set of toning stations might be adjusted so that the toning stations within the set are biased to deposit approximately the same amount of toner.

These as well as other aspects and advantages of the present invention will become apparent from reading the following detailed description, with appropriate reference to the accompanying drawings.

BRIEF DESCRIPTION OF THE DRAWINGS

Exemplary embodiments of the present invention are described herein with reference to the drawings, in which.

DETAILED DESCRIPTION OF EXEMPLARY EMBODIMENTS

A printer or other powder deposition device may use multiple toning stations in order to increase the toning width of the printer or other powder deposition device, thereby also expanding the toning zone of the printer or other powder deposition device. This can then allow the printer or other powder deposition device to effectively tone wide print formats. The toning stations may be arranged in various different configurations in the printer or other powder deposition device, and toning stations may be added or removed from the various configurations in order to further increase or decrease the toning width of the printer or other powder deposition device.

It should be understood that while the discussion herein might generally describe embodiments directed toward printers, the concepts discussed might also be applied to any other powder deposition device. Therefore, any reference to "printer" or "printers" should not be construed as strictly limited to these types of devices but rather might apply to any other powder deposition device as well. Powder deposition devices and techniques are discussed in co-pending U.S. Provisional Patent Application Ser. No. 60/551,464, titled "Powder Coating Apparatus and Method of Powder Coating Using an Electromagnetic Brush," filed on Mar. 9, 2004, which is commonly assigned, and which is incorporated herein by reference.

Using multiple toning stations to increase the toning width of the printer can have several advantages. For example, expanding the toning width using multiple toning stations can allow the printer to maintain the same image quality as would be obtained by using a single toning station. The printer would not suffer from the degradation in image quality that could otherwise result from expanding the toning width of the printer through increasing the length of the toning roller.

Additionally, various embodiments may expand the toning width of the printer using currently available toning stations. Using currently available toning stations may allow a printer to be conveniently modified to use multiple toning stations without requiring expensive, additional parts or without requiring the manufacture of specialized toning stations. These are merely examples, and other advantages may also exist.

Figure 1A:
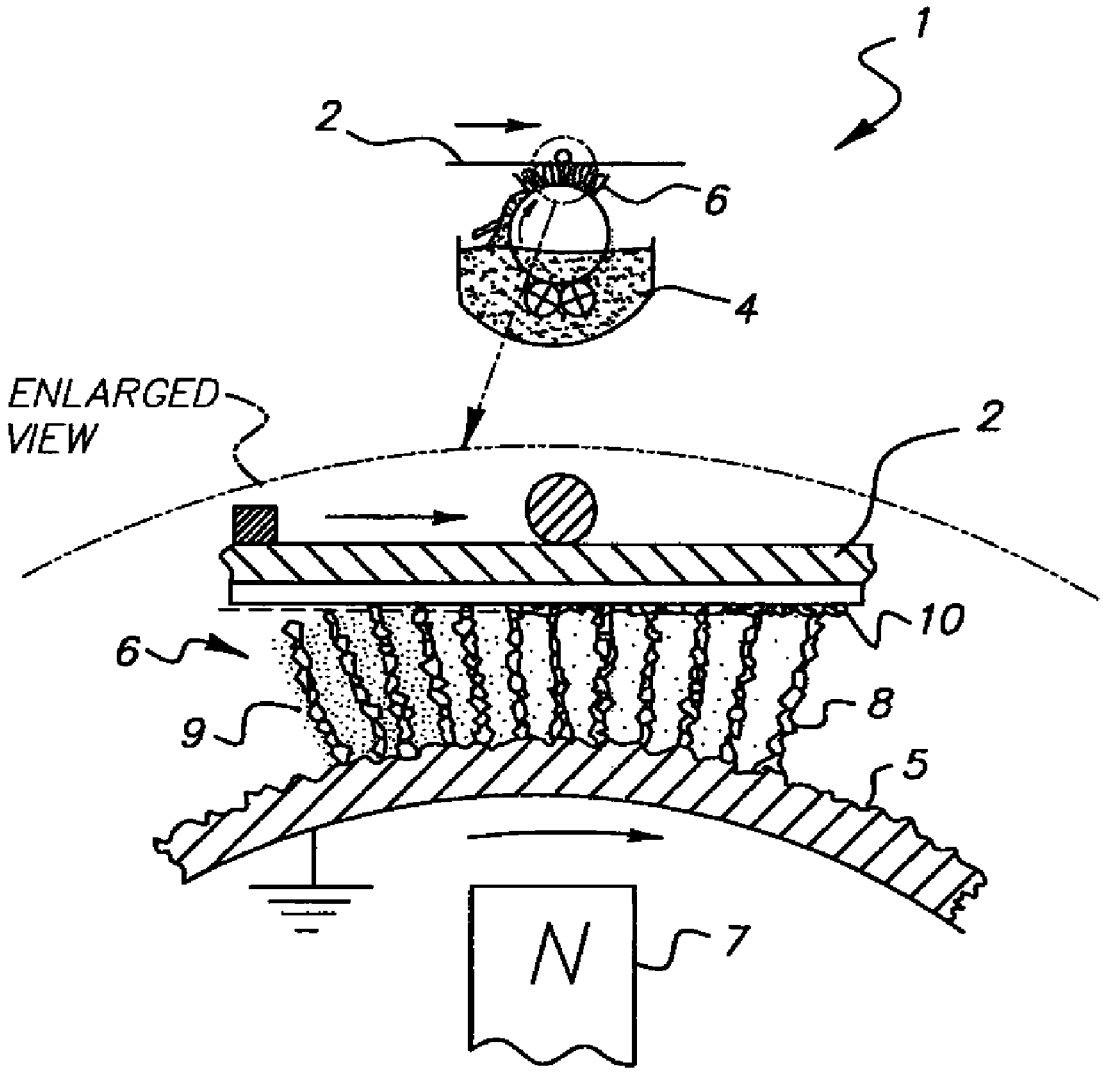
FIG. 1A,B,C is a block diagram of an exemplary configuration of multiple toning stations in a printer or other powder deposition device, wherein the toning stations are arranged so that a gap between the toning stations is in a margin at the center of an electrostatic image.
Figure 1B:
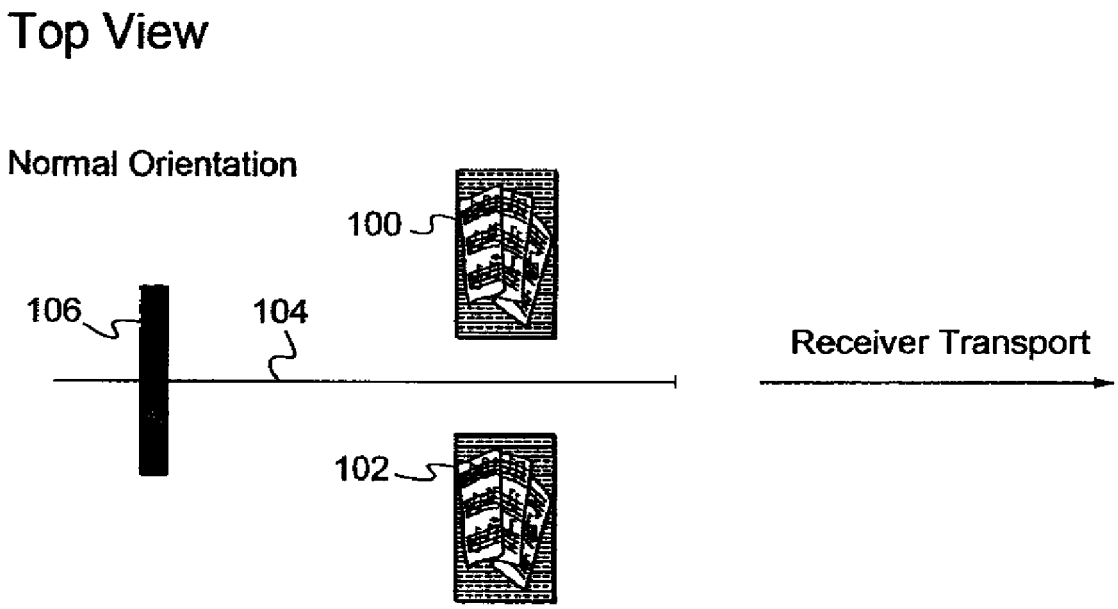
Figure 1C:
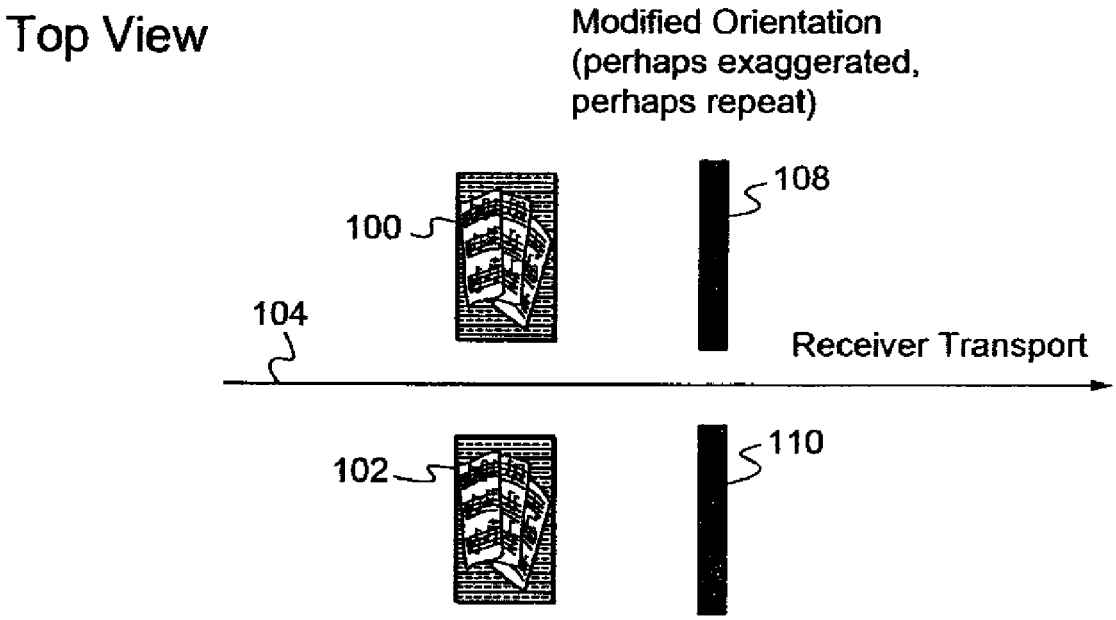

FIGS. 1B and 1C show block diagrams of an exemplary configuration of multiple toning stations in a printer or other powder deposition device, wherein the toning stations are arranged so that a gap between the toning stations is in a margin at the center of an electrostatic image. As shown in FIG. 1, the image comprises a first frame 100 and a second frame 102. The first and second frames 100, 102 may be sections to be transferred to a single sheet of a final receiver, such as a newspaper sheet or a 2-up image. Alternatively, the first frame 100 and second frame 102 may be transferred to separate receivers. Still alternatively, a roll of material might be used on which a large number of frames can be printed.

The first and second frames 100, 102 may progress along a receiver transport 104 in the printer in order to be imaged at one or more toning stations. FIG. 1B illustrates a normal orientation, which would represent a configuration using only a singe toning station 106. For the normal orientation, the combined width of the first and second frames 100, 102 exceeds the width of the single toning station 106. Thus, in the normal orientation configuration that only uses the single toning station 106, the printer would not be able to image along the full width of the first and second frames 100, 102.

FIG. 1C illustrates a modified orientation, which represents a configuration of the printer using multiple toning stations. As shown in FIG. 1C, the modified orientation includes a first toning station 108 and a second toning station 110. For the modified orientation, the combined width of the first and second toning stations 108, 110 preferably equals or exceeds the combined width of the first and second frames 100, 102. The modified orientation illustrated in this figure depicts the two toning stations 108, 110 having a combined width that exceeds the combined width of the two frames 100, 102, thereby allowing printer to advantageously print along the full width of the first and second frames 100, 102.

The modified orientation advantageously allows the first toning station 108 to print one half of the receiver, while the second toning station 110 prints the other half of the receiver. For example, the first toning station 108 may print the first frame 100, and the second toning station 110 may print the second frame 102. Thus, the first and second toning stations 108, 110 may be used to extend the print width of the printer such that the printer can now print along the combined width of the first and second frames 100, 102 while still maintaining the print quality afforded by the smaller sizes of the two toning stations 108, 110.

As depicted in FIG. 1C, the first and second toning stations 108, 110 are positioned such that a gap exists between the first and second toning stations 108, 110. This gap creates an area where the first and second toning stations 108, 110 cannot print on the print medium. However, the first and second frames 100, 102 may preferably be positioned such that the gap falls in the margin between the first and second frames 100, 102. For example, the gap between the toning stations may fall within the center of a newspaper sheet, 2-up image or other such print medium. By positioning the receiver in this manner, the gap falls within an area of the receiver that would ordinarily not be printed.

Alternate configurations might position the gap in different locations. And, it is not necessary that one toning station only prints on one frame while the other toning station only prints on another frame. In one embodiment, the positions of the frames 100, 102 relative to the toning stations 108, 110, might be adjusted such that one of the toning stations images on all or part of both frames 100, 102. For example, the first toning station 108 might image all of the first frame 100 and part of the second frame 102, while the second toning station 110 images part of the second frame 102. Other alterations are also possible. For powder coating applications, the two toning stations can be used to coat parallel sections of a final receiver, which can be in either sheet form, in roll form, or in the form of separate articles to be coated.

Figure 2A:
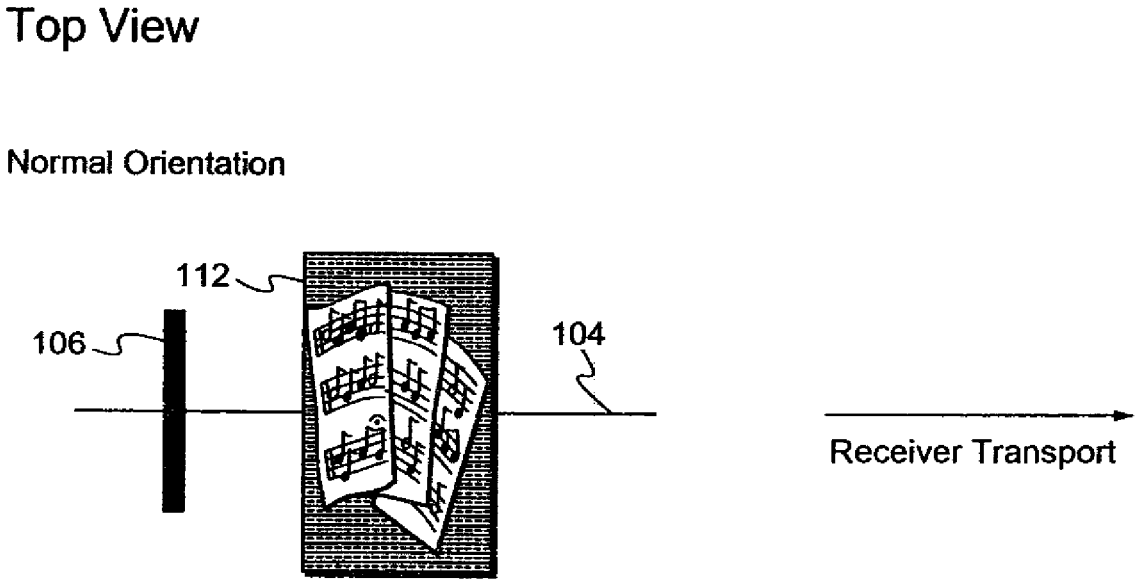
FIGS. 2A and 2B show block diagrams of an exemplary configuration of multiple toning stations in a printer or other powder deposition device, wherein the toning stations are positioned with a long axis of a toning roller perpendicular to a direction of travel of an imaging member or receiver.
Figure 2B:
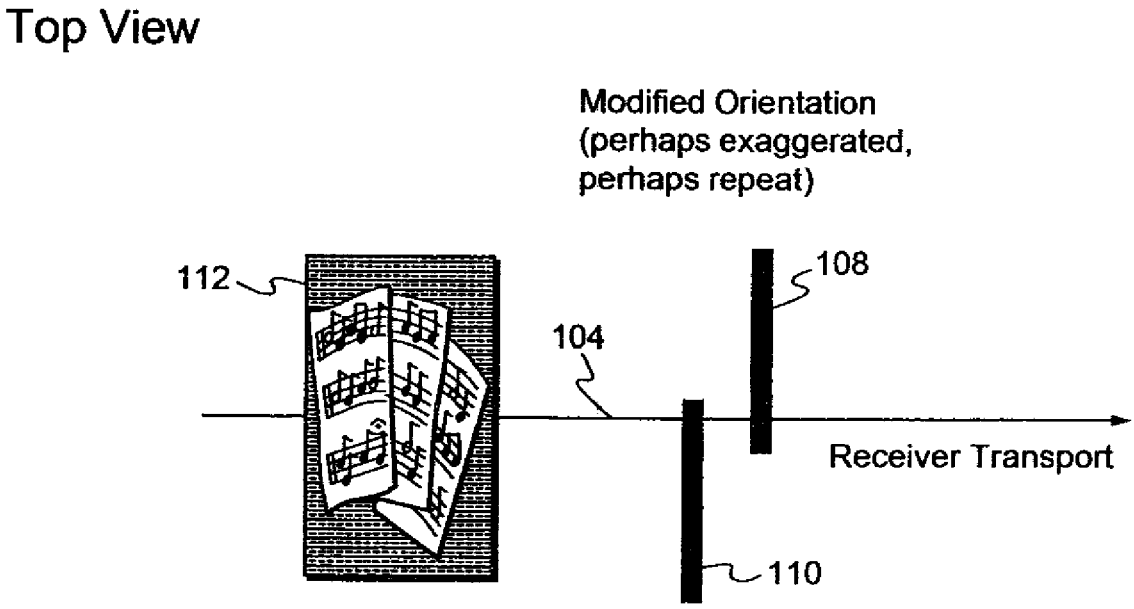

FIGS. 2A and 2B show block diagrams of an exemplary configuration of multiple toning stations in a printer or other powder deposition device, wherein the toning stations are positioned with a long axis of a toning roller perpendicular to a direction of travel of an imaging member or receiver. FIG. 2 depicts an oversized print medium 112 or other receiver, which is generally larger than either of the first or second frames 100, 102 that were depicted in FIG. 1. The normal orientation, which is depicted again in FIG. 2A, illustrates a configuration of the printer using only a single toning station 106. As depicted in FIG. 2A, the width of the oversized print medium 112 exceeds the print width of the single toning station 106, and therefore the single toning station 106 would not be able to print along the full width of the oversized print medium 112.

The modified orientation depicts the printer using multiple toning stations. In the modified orientation of FIG. 2B, the first and second toning stations 108, 110 are positioned in a staggered configuration. Thus, the first and second toning stations 108, 110 overlap such that there is no gap between the first and second toning stations 108, 110. As shown in FIG. 2B, the first and second toning stations 108, 110 preferably overlap along the axis of the receiver transport 104, although it is not necessary that the first and second toning stations 108, 110 always overlap along that axis. Overlapping the first and second toning stations 108, 110, as shown in this configuration, causes a portion of the image on the oversized print medium 112 to pass through two toning nips.

Using multiple toning stations in this staggered configuration advantageously increases the print width of the printer. As depicted in FIG. 2B, the combined print width of the first and second toning stations 108, 110 generally equals or exceeds the width of the oversized print medium 112. Thus, this configuration of the first and second toning stations 108, 110 increases the print width of the printer, thereby allowing the printer to print along the full width of the oversized print medium 112. For powder coating applications, the two toning stations can be used to coat a final receiver, which can be in either sheet form, in roll form, or in the form of separate articles to be coated.

Figure 3A:
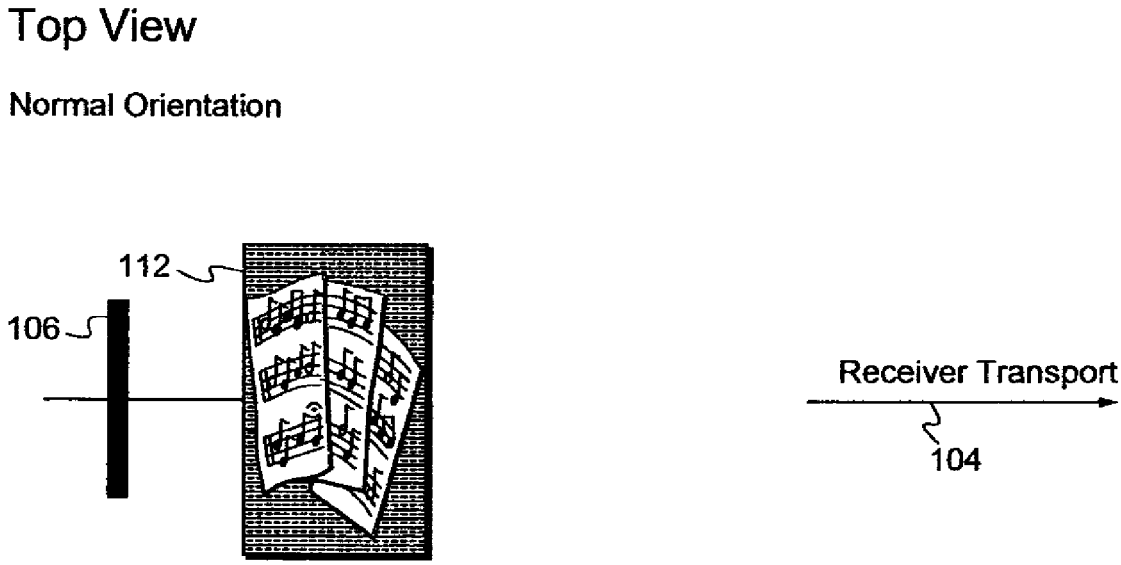
FIGS. 3A and 3B show block diagrams of an exemplary configuration of multiple toning stations in a printer or other powder deposition device, wherein the toning stations are arranged in sequential installations of rows so that all portions of an image or receiver pass through multiple toning nips.
Figure 3B:
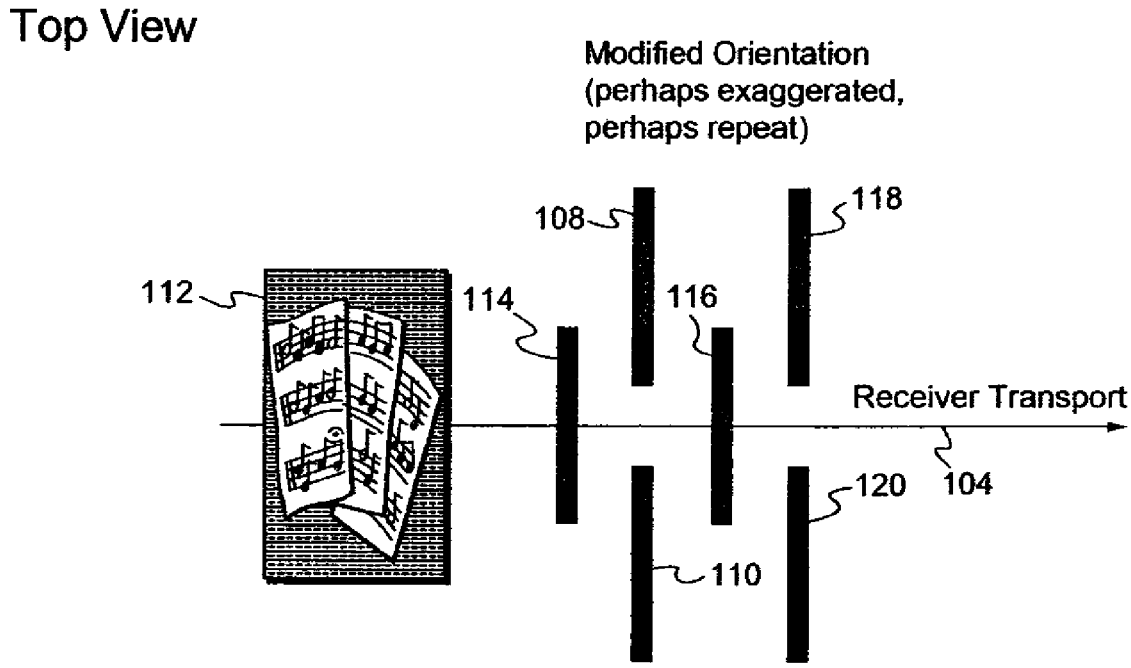

FIGS. 3A and 3B show block diagrams of an exemplary configuration of multiple toning stations in a printer or other powder deposition device, wherein the toning stations are arranged in sequential installations of rows so that all portions of an image or receiver pass through multiple toning nips. FIG. 3A again depicts the single toning station 106 and the oversized print medium 112, and it illustrates that a configuration using only the single toning station 106 would be unable to print along the entire width of the oversized print medium 112.

The modified orientation illustrated in FIG. 3B, which may be used to increase the print width of the printer, includes the first toning station 108 and the second toning station 110. The modified orientation further includes a third toning station 114, a fourth toning station 116, a fifth toning station 118, and a sixth toning station 120. As depicted in FIG. 3B, the toning stations 108, 110, 114-120 may be arranged sequentially in rows.

A first row of toning stations includes the first toning station 108, the second toning station 110 and the third toning station 114. A second row of toning stations includes the forth toning station 116, the fifth toning station 118, and the sixth toning station 120. The rows are arranged such that the toning stations in the first row overlap with the toning stations in the second row.

Staggering the toning stations 108, 110, 114-120 advantageously increases the print width of the printer. This configuration then allows the printer to print along the full width of the oversized print medium 112. Also, arranging the toning stations 108, 110, 114-120 in this configuration allows all portions of an image to pass through multiple toning nips. For powder coating applications, the staggered toning stations can be used to coat a final receiver, which can be in either sheet form, in roll form, or in the form of separate articles to be coated.

It should be understood that many different modifications may be made to the configuration depicted in FIG. 3B. For example, the configuration may include a greater or fewer number of rows. Each row may include a greater or fewer number of toning stations, and different rows may include different numbers of toning stations. Although FIG. 3B depicts the toning stations 108, 110, 114-120 arranged in a symmetric manner, this is not necessary. Also, it should be understood that the particular labels given to the toning stations 108, 110, 114-120 are merely arbitrary, and they may arranged in any manner. These examples are not exhaustive, and other modifications may be made as well.

Figure 4A:
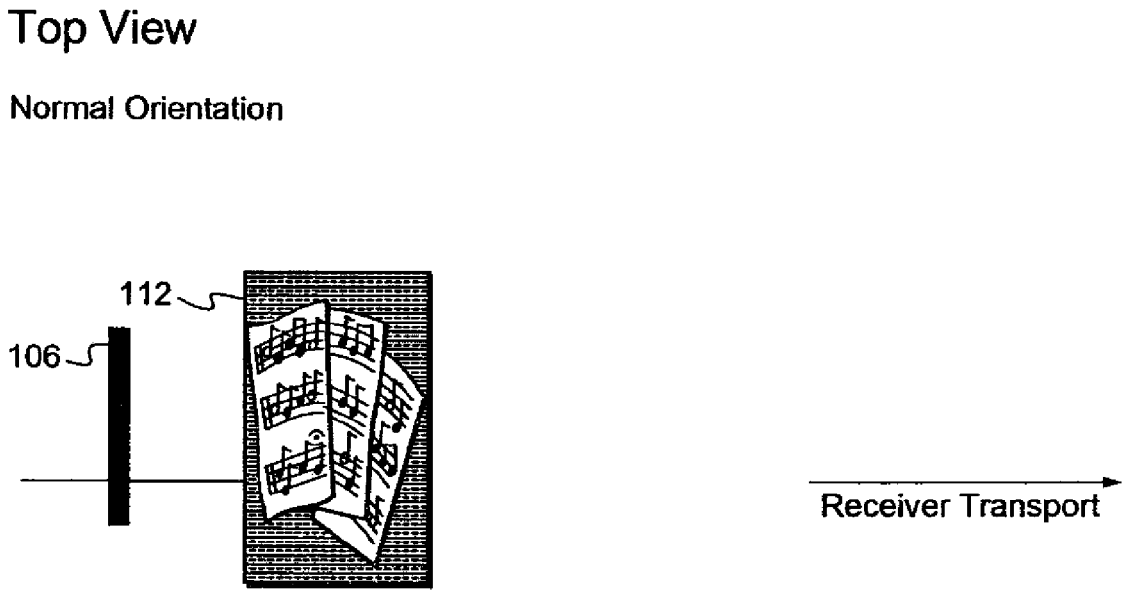
FIG. 4A,4B show block diagrams of an exemplary configuration of multiple toning stations in a printer or other powder deposition device, wherein the toning stations are angled with respect to an imaging member or receiver in a process direction.
Figure 4B:
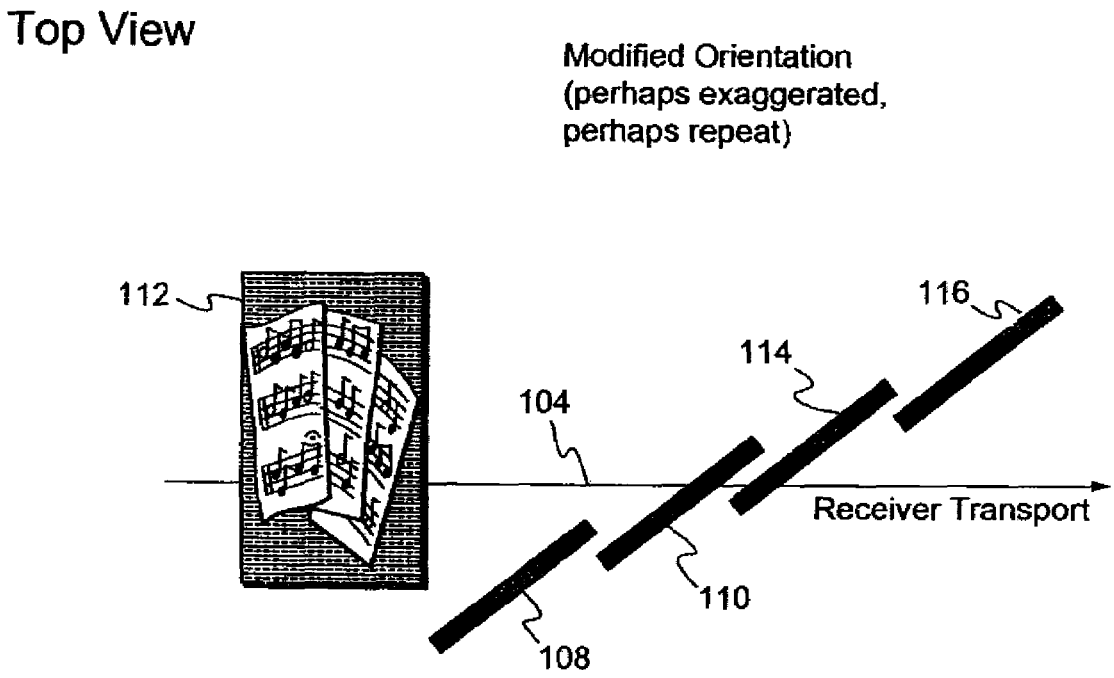

FIGS. 4A and 4B show block diagrams of an exemplary configuration of multiple toning stations in a printer or other powder deposition device, wherein the toning stations are angled with respect to an imaging member or receiver in a process direction. FIG. 4A again depicts the normal orientation, which illustrates that a configuration using only the single toning station 106 would be unable to print along the entire width of the oversized print medium 112.

FIG. 4B depicts a modified orientation, which uses multiple toning stations to increase the print width of the printer. The modified orientation includes the first toning station 108, the second toning station 110, the third toning station 114, and the fourth toning station 116. In the modified orientation, the toning stations 108, 110, 114, 116 are angled with respect to the receiver transport 104. In addition to angling, the toning stations 108, 110, 114, 116 are staggered in order to expand the toning width of the printer. Using this configuration, the printer would be able to print along with full width of the oversized print medium 112.

Many different modifications may be made to the configuration described in FIG. 4B. For example, the printer may include a greater or fewer number of toning stations, and the toning stations 108, 110, 114, 116 may be angled with different orientations. It is not necessary that the toning stations each have the same angle or orientation. Also, the configuration may include some toning stations that are angled and other toning stations that are substantially perpendicular to the axis of the receiver transport. These are merely examples, and other modifications may also be made.

Figure 5:
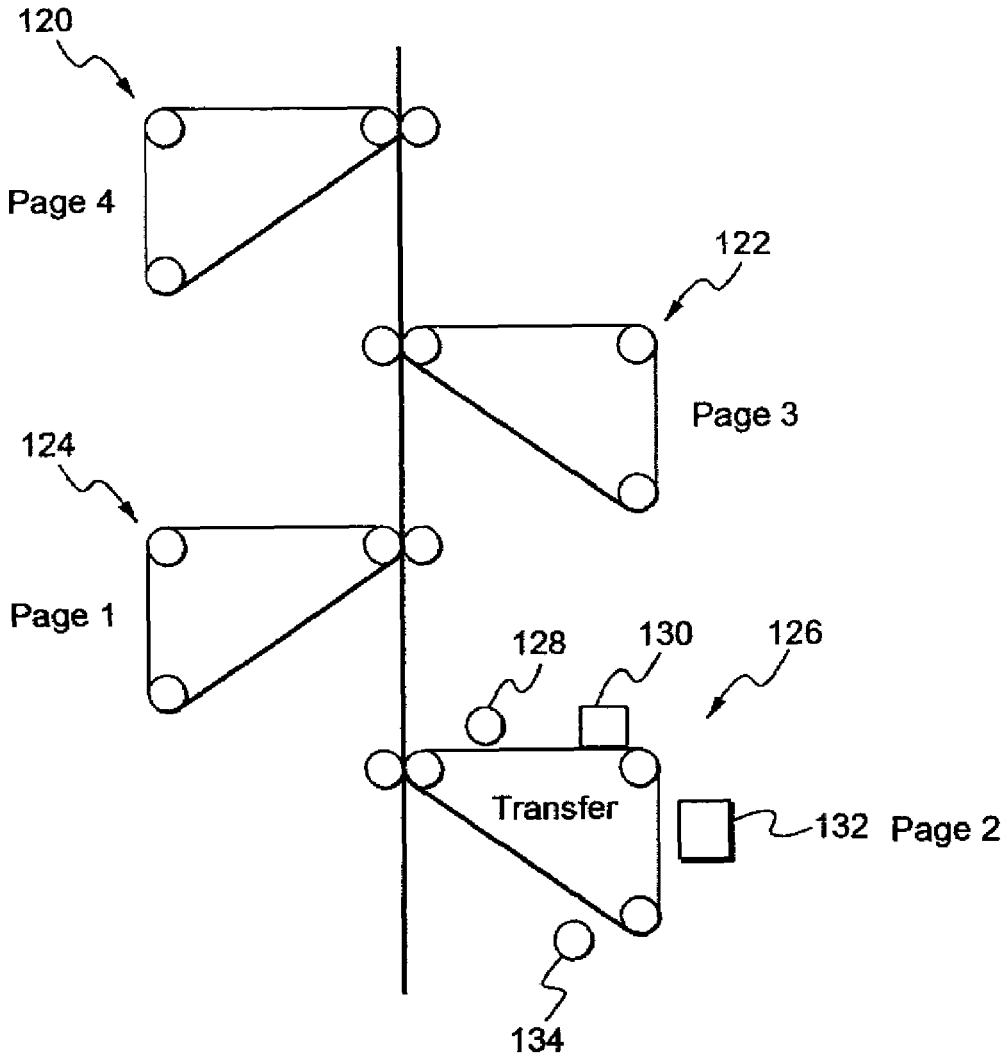
FIG. 5 is a block diagram of an exemplary configuration of multiple toner applicators in a printer or other powder deposition device, wherein the toner applicators are configured to support simultaneous duplex printing or coating.

FIG. 5 is a block diagram of an exemplary configuration of multiple toner applicators in a printer or other powder deposition device, wherein the toner applicators are configured to support simultaneous duplex printing or coating. The printer of FIG. 5 includes a first toner applicator 120, a second toner applicator 122, a third toner applicator 124 and a fourth toner applicator 126. The fourth toner applicator 126 further illustrates various components, including a clean station 128, a charge station 130, an expose station 132 and a develop station or toning station 134. The other toner applicators 120, 122, 124 may also include these components. It should be understood, however, that these components are merely exemplary in nature, and one or more of the toner applicators 120-126 might alternatively use different components. In one embodiment, the toner applicators 120-126 are toning stations; however, they might alternatively be other devices capable of applying toner.

The toner applicators 120, 122, 124, 126 are configured to support simultaneous duplex printing. As shown in FIG. 5, the first toner applicator 120 and the third toner applicator 124 are positioned so that they print on a first side of a print medium. The second toner applicator 122 and the fourth toner applicator 126 are positioned so that they print on a second side of the print medium, thereby supporting simultaneous duplex printing.

The toner applicators 120, 122, 124, 126 may be further positioned so that they print different areas on the same side of the print medium. Thus, the first toner applicator 120 may print a first page, while the third toner applicator 124 may print a third page. The first and third pages may be different areas on the same side of the print medium. In one embodiment the first page and the third page do not overlap, while in an alternate embodiment the first page and the third page do overlap.

Similarly, the second toner applicator 122 may print a second page, and the fourth toner applicator 126 may print a fourth page. The second and fourth pages may be on the same side of the print medium. Thus, the second and fourth pages may be, for example, different areas on the same side of the print medium. In one embodiment, the second page and the fourth page overlap. In another embodiment, the second page and the fourth page do not overlap.

It should be understood that many variations may be made to the configuration depicted in FIG. 5. For example, the printer may include a greater or fewer number of toner applicators. In another example, the toner applicators for printing one side of a print medium may be differently oriented than depicted in FIG. 5, and they may also be differently oriented than the toner applicators for printing the other side of the print medium. Additionally, it is not necessary that the printer include the same number of toner applicators for printing each side of a print medium.

For powder coating applications, the toner applicators can be used to coat a final receiver, which can be in either sheet form, in roll form, or in the form of separate articles to be coated. The toner applicators can apply a layer of powder on a portion of the receiver or across the entire width of the receiver. The powder layers can be applied adjacent to previously applied layers, overlapping previously applied layers, or as a coating on previously applied layers. Other changes to the configuration may also be made.

In the various configurations where the toning stations overlap, the length of the overlap is preferably between one and two inches. However, longer or shorter overlaps might also be used. The mass per unit area of toner particles deposited on the substrate can be greater at the ends of the roller than in the areas near the center of the roller. This can lead to uneven toning away from the center of the roller. In order to reduce this effect, magnets that are tapered at the ends to reduce the magnetic field in the overlap area might be used. However, this may cause a greater carrier particle deposition on the receiver where the magnetic field strength is reduced.

In one embodiment, the overlapping toning stations can each use a metering skive at a fixed distance from the shell, which extends across the entire width of the magnets and the ends of the magnetic roller. The spacing between the skive and the magnetic roller can affect the amount of toner that is deposited, with a smaller spacing corresponding to a smaller deposit of toner. Thus, with a particularly close spacing of the skive, such as a few thousandths of an inch, there will be very little deposition of toner.

The skive can be stepped so that the skive spacing at the ends of the magnetic roller is closer to the toning shell than in the imaging area toward the center of the toning shell. The closer spacing at the ends of the magnetic core can reduce or prevent toner deposition onto the substrate at the ends where laydown may be heavier than at the center of the core. This can reduce or prevent the undesirable toning effects that might otherwise occur at the ends of the toning roller. Other methods, such as a mask located between the toning shell and the receiver, feed rollers of limited width, or magnetic feed rollers limited in width, might alternatively be used in place of or in conjunction with the skive to regulate the deposition of toner and to adjust the maximum imaging width.

Figure 6A:
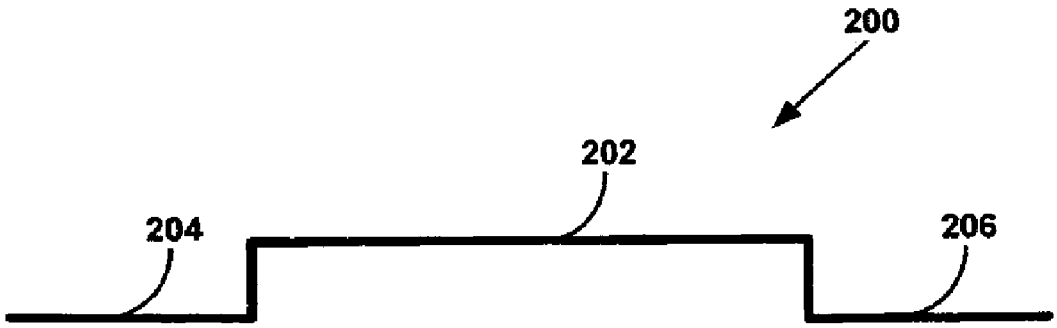
FIGS. 6A-D are block diagrams of exemplary tapered and stepped skives that can be used in overlapping toning stations.
Figure 6B:
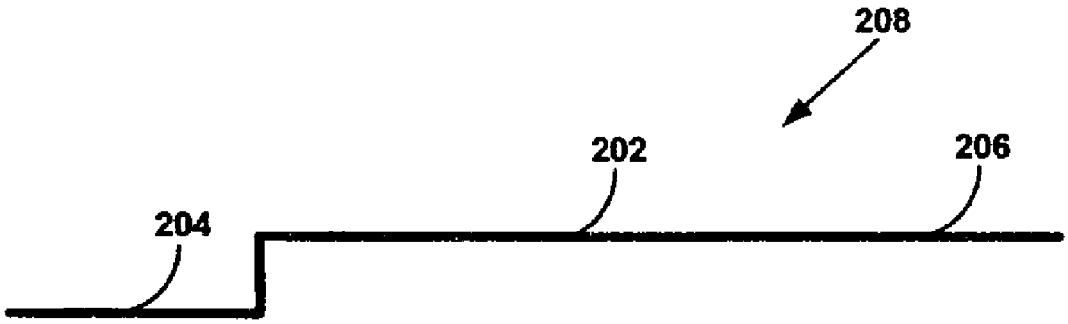

A variety of different configurations might be used for the skive. In one embodiment, the skive may include one step at each end. Thus, the toning roller might have one spacing from the skive at the center of the roller and respectively closer spacings at the two ends of the roller. FIG. 6A depicts a side view of the skive for this particular embodiment. As illustrated, the skive 200 includes a center portion 202 and two end portions 204, 206 that are stepped down from the center portion 202.

When the skive is installed, the center portion 202 can be positioned farther away from the magnetic roller while the steps then position the two end portions 204, 206 closer to the magnetic roller. In one embodiment, the end portions 204, 206 can correspond to the areas of the toning station that overlap with another toning station. Thus, for example, referring to FIG. 3, this skive 200 might be used in a toning station 114 that overlaps with two other toning stations. One end portion 204 of the skive 200 might cover that area that overlaps with one of the two other toning stations, while the other end portion 206 might cover that area that overlaps with the second of the two other toning stations.

Alternatively, the stepped down portions 204, 206 of the skive 200 might not necessarily correspond to an overlapping portion with another toning station. And, still alternatively, the area that overlaps with another toning station might extend past the stepped down portions 204, 206. For example, part of area that overlaps with another toning station might include the center portion 202 of the skive 200.

While a skive might have steps at both ends, it might alternatively only have a step at one end. FIG. 6 depicts a skive 208 with a step at one end 204 but not at the other end 206. In this configuration, the center portion 202 has the same height as the end without the step 206. The end with the step 204 might be in the portion of the toning station that overlaps with another toning station, while the end without the step 206 might be in a portion of the toning station that does not overlap with another toning station. However, as previously described, this is not necessarily always the case.

Figure 6C:
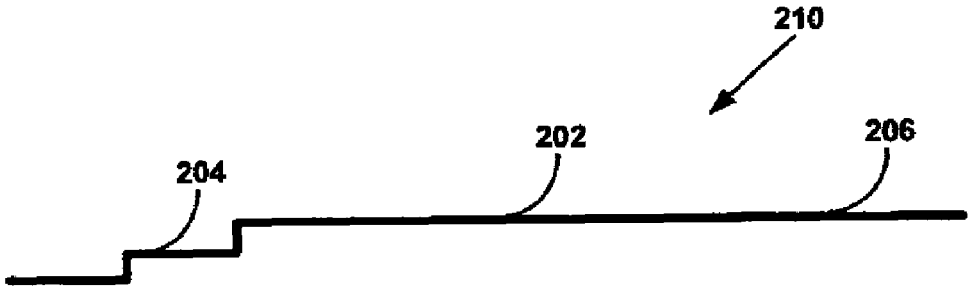

Alternatively, a skive may include a greater number of steps between the center portion and one or both ends of the skive. FIG. 6C depicts a skive 21 that includes two steps at one end 204 of the skive 210. While the other end 206 does not have any steps, it might alternatively have one or more steps. Thus, it is not necessary that each end 204, 206 have the same number of steps.

Figure 6D:
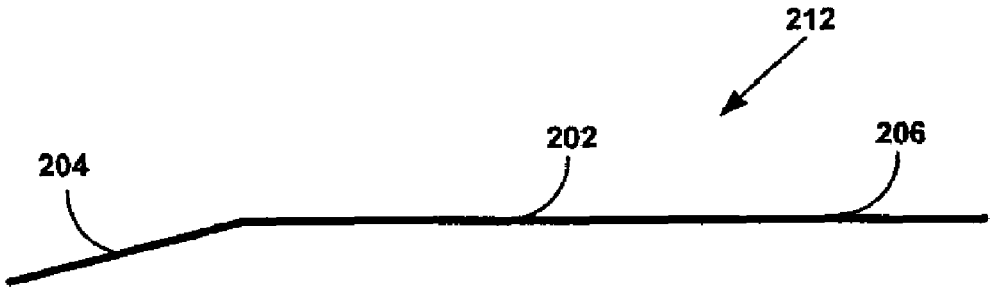

While a skive might use steps, it might alternatively use other shapes in order to position the ends at different distances from the magnetic roller than the center portion. For example, a skive might be tapered near the ends of the roller so that the nap height in the tapered area decreases gradually. Where tapering is used, or alternatively steps or another shape are used, the nap might then become small enough adjacent to the end of the roller that there is little or no deposition of toner near the ends of the roller. FIG. 6D depicts a skive 212 having one tapered end 204 along with a center portion 202 and another end 206.

In one embodiment, the nap height makes a gradual transition over a distance of approximately half an inch from its normal height to the lower nap height used at the ends of the roller. However, greater or lesser degrees of tapering might also be used. Also, both ends 204, 206 might be tapered, or one end might be tapered while the other end might be stepped. Other configurations are possible. Additionally, while FIG. 6D depicts a linear tapering, non-linear tapering might also be used.

Many different modifications may be made to the toning station that have the same effect as a stepped skive or as a tapered skive. For example, the toning shell may be stepped, or the magnetic feed rollers may be modified to only feed developer to the toning roller in the central region of the roller and not at the ends of the roller.

The position of each roller or skive so that the step or taper of each skive aligns with adjacent rollers might be adjusted to produce uniform toner deposition. However, this type of alignment is not always necessary. For example, this might not be done in a preferred embodiment that uses a two-component developer, a rotating magnetic core and a rotating toning shell. For this embodiment, the agitation of the developer nap caused by the rotating magnetic field might produce significant scavenging of toner from the image such that excess toner in the overlapped areas is removed by the downstream toning stations.

In some applications, such as those requiring faster substrate speeds or heavy laydowns, the receiver might pass through multiple sets of toning rollers, with each set including two or more toning rollers. In this configuration, each point on the receiver might then pass through at least two toning rollers. In order to control the amount of toner being deposited by the multiple toning stations, the printer might include various process control mechanisms.

Process control might be performed using densitometers, electrometers or other mechanisms that measure the amount of toner on the substrate. Where multiple sets of toning stations are used, the first set of toning stations that the receiver passes through typically deposits the majority of the mass per unit area. The second, third or other subsequent sets of toning stations each generally deposit less than the first set of toning stations. In this way, fluctuations in mass per unit area produced by the last set of toning stations that the receiver passes through will be less than that produced by the first set of toning stations. Accordingly, any non-uniformity produced by the first set of toning stations can be evened out by subsequent sets of toning stations.

For example, if two sets of toning stations are used with positively charged toner and a conductive substrate, the first set of toning stations might be biased to 750V with respect to the substrate bias, which is usually ground. The second set of toning stations might then be biased to 1000V with respect to the substrate bias. Of course, these particular biases are merely exemplary in nature, and other biases might also be used.

Additionally, it is preferable that each toning station within each set of toning stations deposits the same amount of toner. However, various operating conditions might affect the amount of toner than a toning station deposits at a particular bias. Thus, even though two toning stations within a set of toning station might be initially set to a particular bias, these operating conditions might cause one of the toning stations to deposit more toner than the other toning station.

In order to account for these operational effects, the biases of the toning stations within each set of toning stations might also be adjusted during operation of the printer. For example, each toning station might include a densitometer, an electrometer and/or other devices to measure the amount of toner deposited by the toning station, and it might then use the measurements to adjust the amounts of toner deposited by the toning stations.

Figure 7:
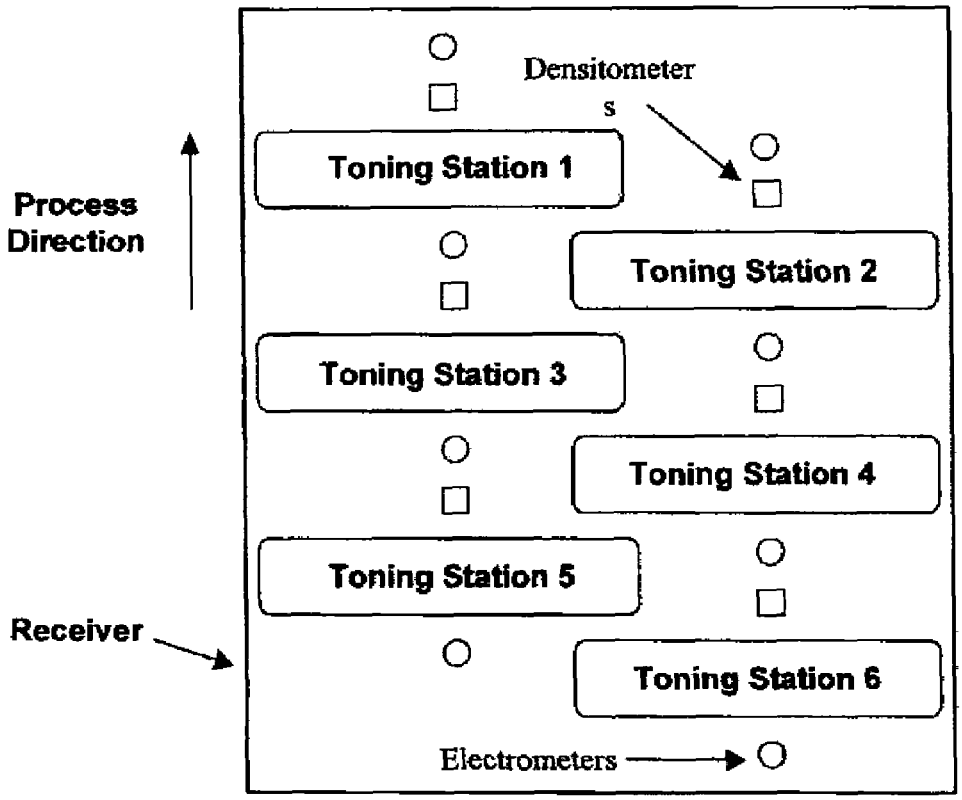
FIG. 7 is a block diagram illustrating an electrophotographic printer or other powder deposition device having multiple sets of overlapping toning stations that include electrometers and deposition measuring devices, such as densitometers, for use in process control.

FIG. 7 is a block diagram illustrating an electrophotographic printer or other powder deposition device having multiple sets of overlapping toning stations that include electrometers and deposition measuring devices, such as densitometers, for use in process control. As depicted, the printer includes six toning stations but might alternatively include a greater or fewer number of toning stations. Each toning station includes an electrometer and a densitometer for measuring the amount of toner deposited by that toning station. The electrometers are generally denoted by circles, while the densitometers are generally denoted by squares.

While this figure depicts each toning station as having both an electrometer and a densitometer, alternative embodiments might use only an electrometer or only a densitometer. Additionally, a toning station might include other components used in measuring the amount of toner it deposits, such as a powder layer thickness measuring device. And, different toning stations might use different components. For example, one toning station might use an electrometer, while another toning station might use a densitometer. Other variations are also possible.

Regardless of the particular method used to measure the amount of toner deposited by a toning station, the measurement might then be compared to the amount of toner deposited by other toning stations in the set of toning stations. The biases of one or more of the toning stations might then be adjusted in order to approximately equalize the amount of toner deposited by each toning station in the set of toning stations, thereby providing process control for the toning stations in the printer.

Figure 8A:
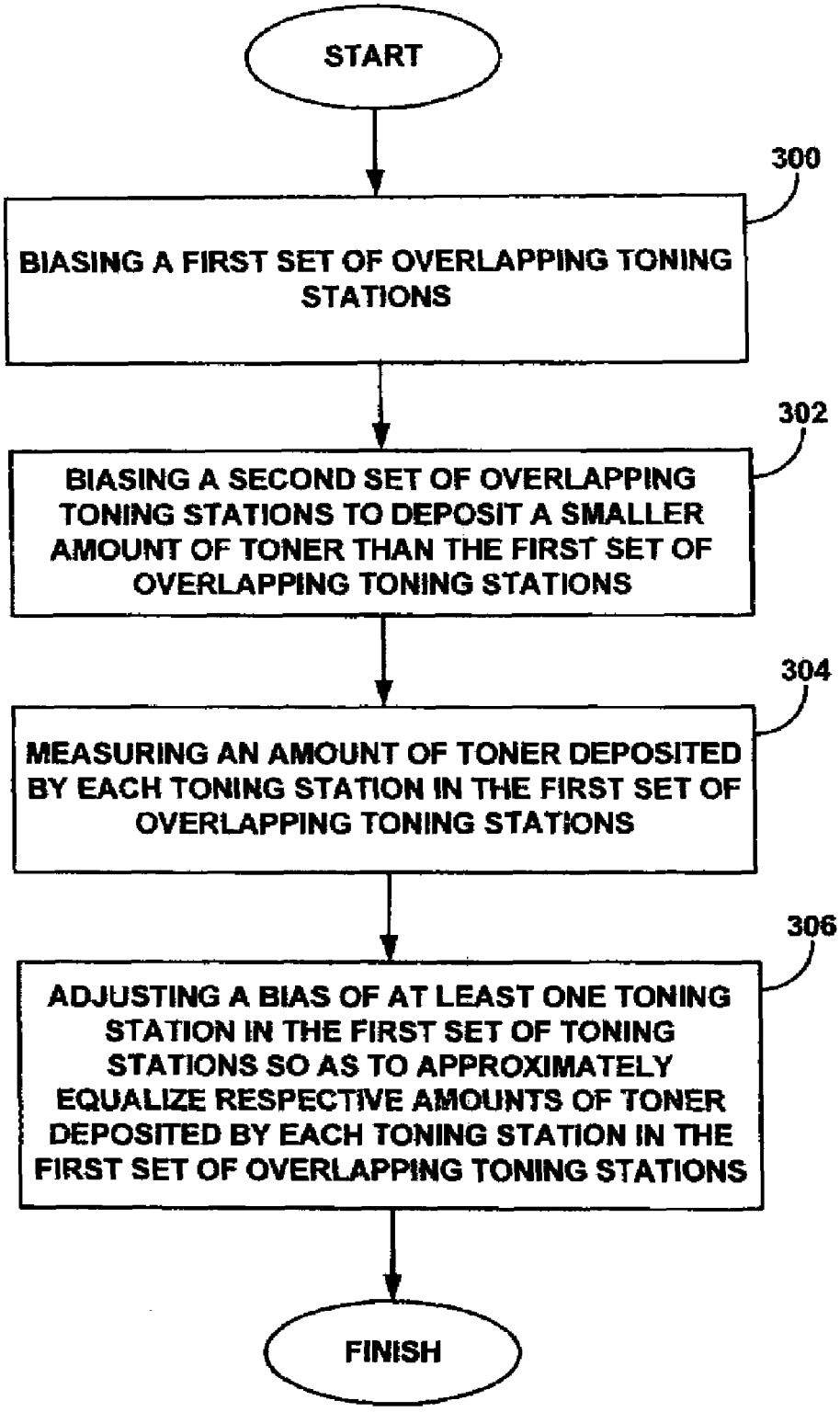
FIGS. 8A-C are flowcharts of exemplary methods of process control in a printer or other powder deposition device having multiple sets of overlapping toning stations.

FIG. 8A is a flowchart of an exemplary method for process control in a printer or other powder deposition device having multiple sets of overlapping toning stations. For example, this method might be used in a printer that has sets of overlapping toning stations. At Step 300, the printer biases a first set of overlapping toning stations. At Step 302, the printer biases a second set of overlapping toning stations to deposit a smaller amount of toner than the first set of overlapping toning stations.

At Step 304, the printer measures an amount of toner deposited by each toning station in the first set of toning stations. Then, the printer adjusts a bias of at least one toning station in the first set of toning stations so as to approximately equalize the respective amounts of toner deposited by each toning station in the first set of overlapping toning stations, as shown at Step 306. As previously described, even though toning stations in the first set of toning stations are biased to the same voltage, operational conditions might cause one toning station to deposit more toner than another toning station. The can then cause uneven image quality in images printed by the printer.

Through this method, the printer can dynamically adjust the biases of toning stations in the first set of toning stations in order to approximately equalize the respective amounts of toner deposited by the toning stations in the first set of toning stations. For example, the first set of toning stations might include two toning stations. After detecting a difference in the amount of toner deposited by the two toning stations, the printer might increase the bias of one of the toning stations while not changing the bias of the other station in order to approximately equalize the amount of toner deposited by the two toning stations.

Alternatively, the printer might decrease the bias of one toning station and not change the bias of the other toning station. Still alternatively, the printer might change the biases of both the toning stations. In other embodiments, the first set of toning stations might include more than two toning stations, and the printer might equalize the amount of toner deposited by the toning stations by adjusting the biases of some or all of the toning stations in the first set of toning stations. The printer might similarly adjust the biases of toning stations in other sets of toning stations.

Figure 8B:
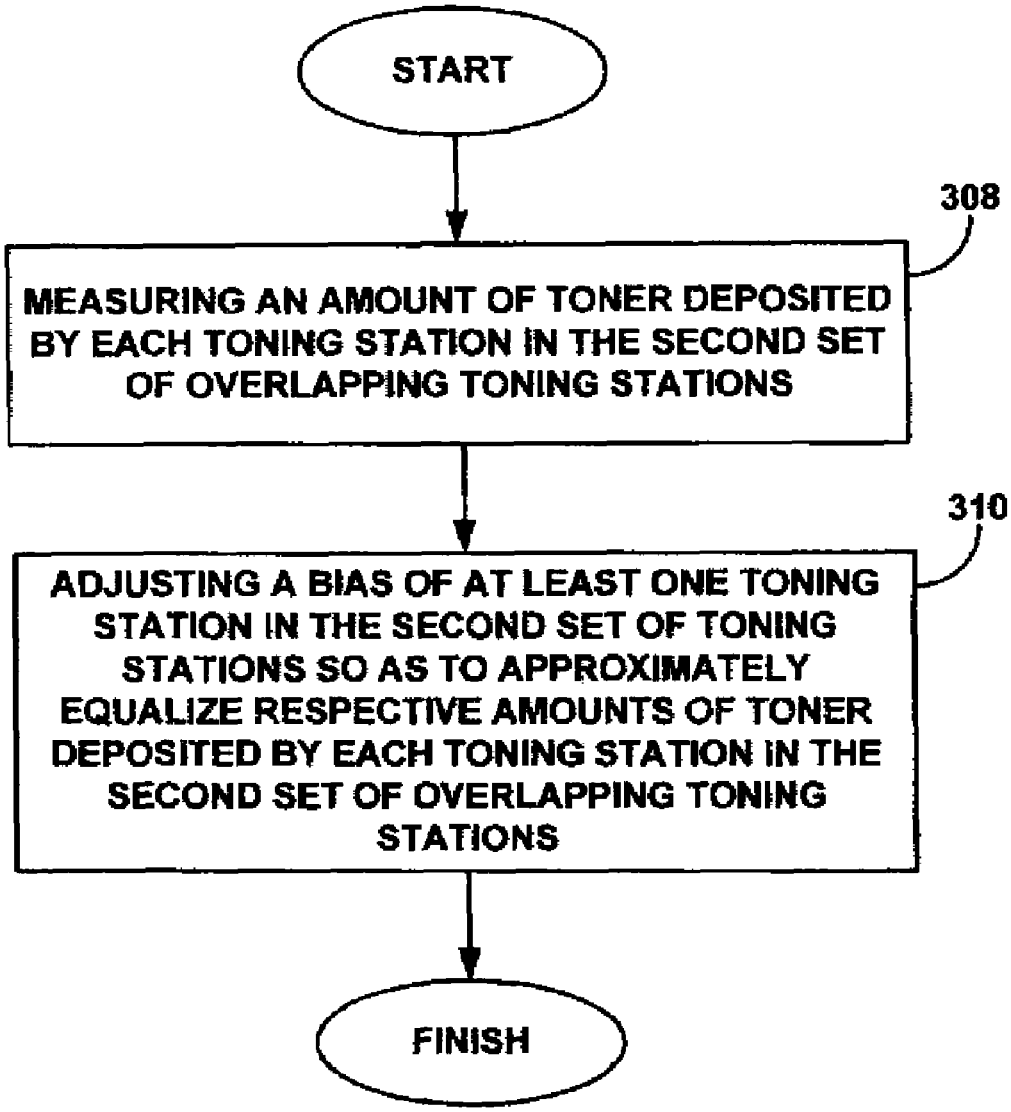

FIG. 8B is a flowchart of an exemplary method for process control that can be used in conjunction with the flowchart of FIG. 8A in order to adjust biases of toning stations in multiple sets of overlapping toning stations. For example, this method can be used in conjunction with the method depicted in FIG. 8A in order to allow the printer to adjust the biases of toning stations in a first set of overlapping toning stations and also in a second set of overlapping toning stations.

At Step 308, the printer measures an amount of toner deposited by each toning station in the second set of overlapping toning stations. Then, at Step 310, the printer adjusts a bias of at least one toning station in the second set of toning stations so as to approximately equalize the respective amounts of toner deposited by each toning station in the second set of toning stations. If the printer includes more than two sets of toning stations, a similar process might be performed for the other sets of toning stations.

Also, part or all of the processes described in FIGS. 8A-B might be periodically or continually performed by the printer. For example, the printer might initially set the biases of toning stations in the sets of toning stations. The printer might then periodically or continually measure the amounts of toner deposited by the toning stations in the sets of toning stations and then adjust their biases so as to keep toning stations in the same set of toning stations depositing approximately the same amount of toner throughout the operation of the printer.

In addition to performing process control in order to regulate the relative amounts of toner deposited by toning stations within a particular set of toning station, the printer or other powder deposition device might perform process control in order to regulate the relative amounts of toner deposited by different sets of toning stations. For example, a printer might initially begin operating with each set of toning stations depositing a specified amount of toner relative to other sets of toning stations. However, changes in toner charge or other effects during the operation of the printer may cause a change in the relative amounts of toner deposited by different sets of toning stations. This might in turn cause undesired changes in the quality of resulting images.

Figure 8C:
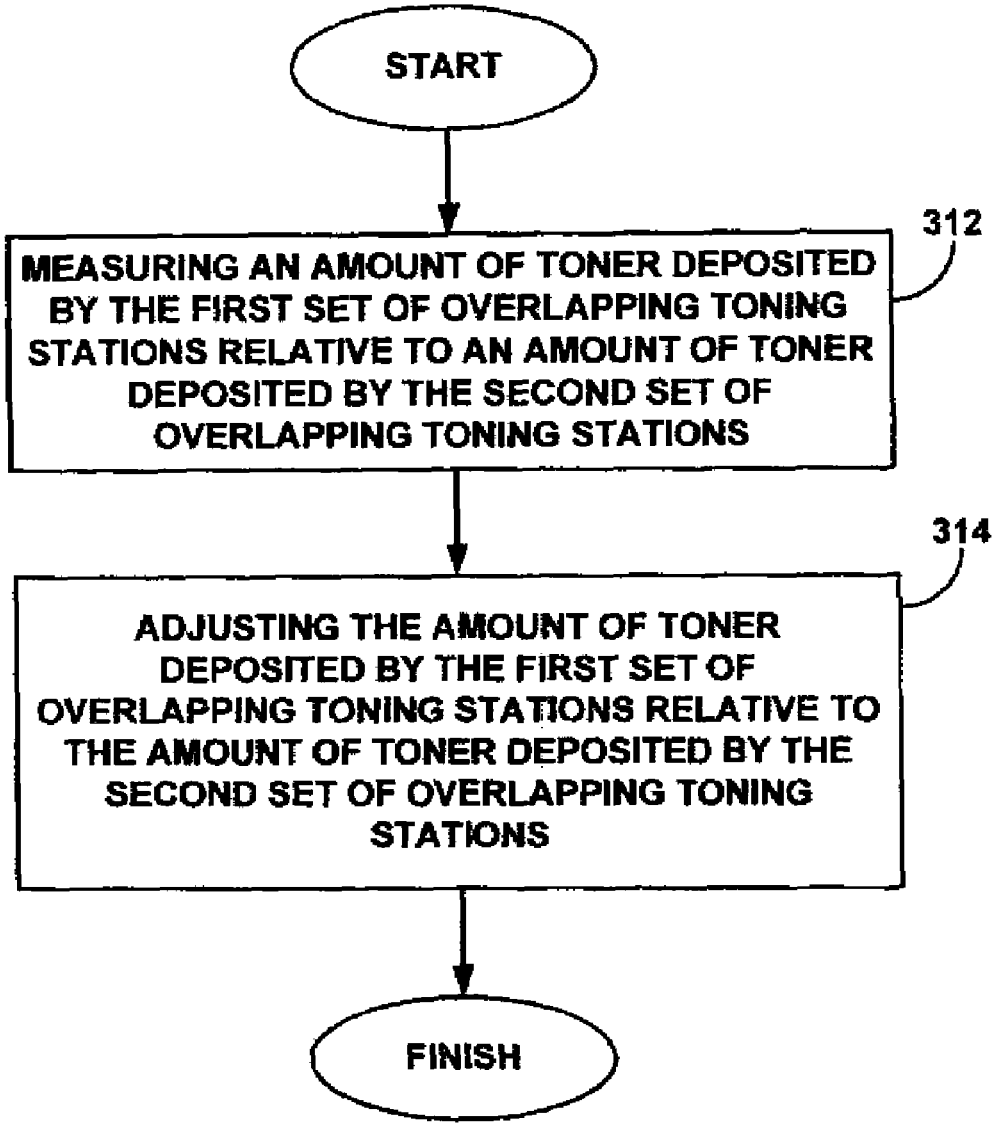

FIG. 8C is a flowchart of an exemplary method for process control in a printer or other powder deposition device having multiple sets of toning stations that can be used to adjust the relative amounts of toner deposited by the sets of toning stations. This method might be used in conjunction with the methods of FIGS. 8A and 8B, or alternatively it might be used apart from the methods of FIGS. 8A and 8B. That is, a printer or other powder deposition device might adjust the amounts of toner deposited by toning stations within the same set of toning stations relative to each other, and at the same time the printer or other powder deposition device might adjust the amounts of toner deposited by sets of toning stations relative to other sets of toning stations. However, the printer or other powder deposition device might alternatively perform one of these process control methods but not the other.

At Step 312, the printer measures an amount of toner deposited by the first set of overlapping toning stations relative to an amount of toner deposited by the second set of overlapping toning stations. At Step 314, the printer adjusts the amount of toner deposited by the first set of overlapping toning stations relative to the amount of toner deposited by the second set of overlapping toning stations. This might be done, for example, by adjusting the amount of toner deposited by the first set of overlapping toning stations, adjusting the amount of toner deposited by the second set of overlapping toning stations, or adjusting the amount of toner deposited by both the first and second sets of overlapping toning stations. Where the printer includes more than two sets of overlapping toning stations, the relative amounts of toner deposited by some or all of the toning stations with respect to each other might be regulated.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

The invention claimed is:

1. A method for process control in a printer having multiple sets of overlapping toning stations, the method comprising:

biasing a first set of overlapping toning stations;

biasing a second set of overlapping toning stations to deposit a smaller amount of toner than the first set of overlapping toning stations;

measuring an amount of toner deposited by each toning station in the first set of overlapping toning stations; and adjusting a bias of at least one toning station in the first set of overlapping toning stations so as to approximately equalize respective amounts of toner deposited by each toning station in the first set of overlapping toning stations.

2. A computer readable medium having stored therein instructions for causing a processor to execute the method of claim 1.

3. The method of claim 1, further comprising:

measuring an amount of toner deposited by each toning station in the second set of overlapping toning stations; and adjusting a bias of at least one toning station in the second set of toning stations so as to approximately equalize respective amounts of toner deposited by each toning station in the first set of overlapping toning stations.

4. The method of claim 3, wherein measuring an amount of toner deposited by each toning station in the first set of overlapping toning stations comprises taking respective densitometer or electrometer readings or readings of the thickness of the deposited powder layer for each toning station in the first set of overlapping toning stations, and wherein measuring an amount of toner deposited by each toning station in the second set of overlapping toning stations comprises taking respective densitometer or electrometer readings or readings of the thickness of the deposited powder layer for each toning station in the second set of overlapping toning stations.

5. The method of claim 1, wherein biasing the first set of toning stations comprises biasing the first set of toning stations to a first bias voltage with respect to a substrate bias, and wherein biasing the second set of toning stations comprises biasing the second set of toning stations to a second bias voltage lower in magnitude than two times the first bias voltage, with respect to the substrate bias.

6. The method of claim 1, wherein measuring an amount of toner deposited by each toning station in the first set of overlapping toning stations comprises taking respective densitometer or electrometer readings or readings of the thickness of the deposited powder layer for each toning station in the first set of overlapping toning stations.

7. The method of claim 1, further comprising:

measuring an amount of toner deposited by the first set of overlapping toning stations relative to an amount of toner deposited by the second set of overlapping toning stations; and adjusting the amount of toner deposited by the first set of overlapping toning stations relative to the amount of toner deposited by the second set of overlapping toning stations.

8. A method for dynamic process control in a powder deposition device having multiple sets of toning applicators, the method comprising:

biasing a first set of toning applicators;

biasing a second set of toning applicators to deposit a smaller amount of toner than the first set of toning applicators;

measuring an amount of toner deposited by the first set of toning applicators relative to an amount of toner deposited by the second set of toning applicators; and adjusting the amount of toner deposited by the first set of toning applicators relative to the amount of toner deposited by the second set of toning applicators.

9. A computer readable medium having stored therein instructions for causing a processor to execute the method of claim 8.

10. The method of claim 8, wherein adjusting the amount of toner deposited by the first set of toning applicators relative to the amount of toner deposited by the second set of toning applicators comprises adjusting the amount of toner deposited by the first set of toning applicators.

11. The method of claim 8, wherein adjusting the amount of toner deposited by the first set of toning applicators relative to the amount of toner deposited by the second set of toning applicators comprises adjusting the amount of toner deposited by the second set of toning applicators.

12. The method of claim 8, wherein adjusting the amount of toner deposited by the first set of toning applicators relative to the amount of toner deposited by the second set of toning applicators comprises adjusting the amount of toner deposited by both the first and second sets of toning applicators.

13. A method for process control in a printer having multiple sets of toning applicators providing an increased process width, the method comprising:

biasing a first set of toning applicators;

biasing a second set of toning applicators to deposit a smaller amount of toner than the first set of toning applicators;

measuring an amount of toner deposited by each toning applicator in the first set of toning applicators; and adjusting a bias of at least one toning applicator in the first set of toning applicators so as to approximately equalize respective amounts of toner deposited by each toning applicator in the first set of toning applicators.

14. The method of claim 13, further comprising:

measuring an amount of toner deposited by each toning applicator in the second set of toning applicators; and adjusting a bias of at least one toning applicator in the second set of toning applicators so as to approximately equalize respective amounts of toner deposited by each toning applicator in the second set of toning applicators.

15. A method for process control in a printer having multiple sets of overlapping toning stations, the method comprising the steps of.

positioning a first set of overlapping toning stations comprising a first toning roller and a first rotating magnetic core for forming a magnetic brush, wherein the first set is positioned with a long axis of the respective toning rollers, substantially perpendicular to a receiver transport path and offset a distance, to deposit a measured amount of toner for printing on a first area of a print medium receiver;

positioning a second set of overlapping toning stations comprising a second toning roller and a second rotating magnetic core for forming a magnetic brush, wherein the second set is positioned with a long axis of the respective toning rollers, substantially perpendicular to a receiver transport path and offset a distance, to deposit a measured amount of toner both in an extended width area and the same area relative to the first set of overlapping toning stations for printing on a second area of a print medium receiver;

measuring an amount of toner deposited by each toning station in the first set of overlapping toning stations; and adjusting the electric bias of at least one toning station in the first set of overlapping toning stations so as to approximately equalize respective amounts of toner deposited by each toning station in the first set of overlapping toning stations print medium receiver while the respective magnetic brushes are in contact with a receiver.

16. The method of claim 15, further comprising:

measuring an amount of toner deposited by each toning station in the second set of overlapping toning stations; and adjusting a bias of at least one toning station in the second set of toning stations so as to approximately equalize respective amounts of toner deposited by each toning station in the first set of overlapping toning stations.

17. The method of claim 15 stations, wherein adjusting the amount of toner deposited by the first set of toning relative to the amount of toner deposited by the second set of toning stations comprises adjusting the amount of toner deposited by the second set of toning stations.

18. The method of claim 15, further comprising:

controlling a portion of one or more toning stations is wherein relative amounts of toner is deposited by some or all of the toning stations with respect to each other.

* * * * *